US005441157A

United States Patent [19]

Fjällström

[11] Patent Number: 5,441,157

[45] Date of Patent: Aug. 15, 1995

[54] METHOD AND DEVICE FOR SEPARATING A SUSPENSION, PREFERABLY A FIBRE SUSPENSION

[75] Inventor: Roland Fjällström, Lawrenceville, Ga.

[73] Assignee: Celleco Hedemora AB, Stockholm, Sweden

[21] Appl. No.: 119,222

[22] PCT Filed: Jan. 28, 1993

[86] PCT No.: PCT/SE93/00062

§ 371 Date: Jan. 12, 1994

§ 102(e) Date: Jan. 12, 1994

[87] PCT Pub. No.: WO93/15265

PCT Pub. Date: Aug. 5, 1993

[30] Foreign Application Priority Data

Jan. 28, 1992 [SE] Sweden ..... 9200233

[51] Int. Cl.[6] ..... B07B 1/08

[52] U.S. Cl. ..... 209/271; 209/350; 162/55

[58] Field of Search ..... 209/271, 268, 350; 162/55

[56] References Cited

U.S. PATENT DOCUMENTS 5,124,029 6/1992 Fjällström et al. ..... 209/271 X

FOREIGN PATENT DOCUMENTS 334312 9/1989 European Pat. Off. .

9006396 6/1990 WIPO .

*Primary Examiner*—David H. Bollinger

*Attorney, Agent, or Firm*—Davis Hoxie Faithfull & Hapgood

[57] ABSTRACT

A suspension containing fine and coarse particles is sprayed under high pressure by way of spray nozzles (10) against a rotating filter medium (7), so that the suspension is separated into a fine fraction, which passes through the filter medium and which contains said fine particles, and a coarse fraction, which does not pass through the filter medium and which contains said coarse particles. According to the invention the filter medium (7) is rotated by way of a drive motor (6) at a speed such that coarse particles and liquid developing on the side of the filter medium are removed from the filter medium substantially as the result of the centrifugal force the coarse particles and liquid are subjected to. In consequence the filter medium is efficiently kept clean during operation, which increases the capacity and improves the separation efficiency.

7 Claims, 3 Drawing Sheets

METHOD AND DEVICE FOR SEPARATING A SUSPENSION, PREFERABLY A FIBRE SUSPENSION

Figure 1:
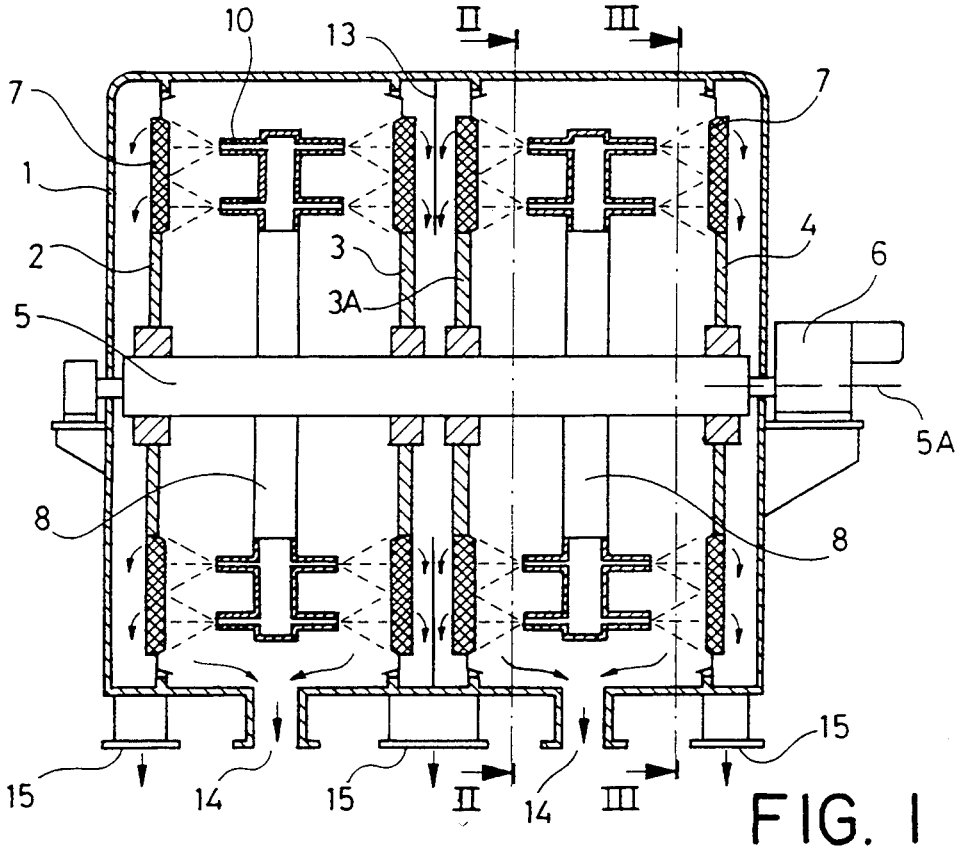

The present invention relates to a method of separating a suspension containing relatively fine particles and relatively coarse particles by spraying the suspension against a side of a rotating filter medium, so that a fine fraction of the suspension containing said fine particles passes through the filter medium, while a coarse fraction of the suspension containing said coarse particles does not pass through the filter medium. The present invention also relates to a device for such a separation.

A method and a device of these kinds are known from WO 90/06395. The known device comprises circular vertical rotatable discs covered with liter media, stationary spray nozzles adapted to spray one side of each disc with high pressure jets of the fibre suspension to be separated, and stationary cleansing spray nozzles adapted to spray the discs with cleansing liquid for cleansing the filter media. During operation of the known device the discs are sprayed with the fibre suspension and the cleansing liquid while the discs are rotated, whereby coarse particles and liquid developing on the discs flow by gravity down the discs to outlets situated below the discs.

The known device according to WO 90/06396 has proved especially usable and advantageous for fractionating fibre suspensions, since clogging of the filter media is efficiently prevented during operation. However, the known device has a relatively limited capacity with regard to the flow each disc is capable of receiving. Thus, a too thick layer of coarse particles is not allowed to have time to develop on the discs during operation. Thick layers of coarse particles deteriorate the separation efficiency, since they prevent the high pressure jets of fibre suspension from hitting the filter media directly.

To provide a quick removal of coarse particles from the discs of the known device also at the ascending sides of the discs, the rotational speed of the discs is relatively low. The low rotational speed of the discs allows the coarse particles and liquid to leave the discs by gravity, though the coarse particles are subjected to an upwardly directed entrainment effect at the ascending sides of the discs, when the filter discs are rotated. The discs of the known device, which has a diameter of about three metres, are therefore rotated relatively slowly during operation, at a few revolutions per minute at most. In consequence, the filter media are completely cleansed by the cleansing spray nozzles only a few times per minute.

The object of the present invention is to provide an improved method of separating a suspension which allows an increase in the flow capacity per unit of area of the filter medium and which improves the separation efficiency.

This object is obtained by a method of the kind stated initially, which primarily is characterized by rotating the filter medium at a speed such that coarse particles and liquid developing on said side of the filter medium are removed from the filter medium substantially as a result of the centrifugal force said coarse particles and liquid are subjected to by the rotating filter medium. Since the coarse particles are quickly removed from the filter medium by centrifugal force, the capacity of the filter medium can be increased, compared with the known method described above. In other words, the filter medium can be loaded with a larger flow per unit of area. In addition, the separation efficiency can be improved, since the relatively high rotational speed which has to be imparted to the filter medium, in order to provide sufficiently strong centrifugal forces, has the consequence that the filter medium passes stationary cleansing spray nozzles at a higher rate than previously, so that the filter medium is cleansed more frequently.

The capacity of the filter medium can be further increased by spraying the suspension against said side of the filter medium in at least two spray zones, which are spaced from each other in the direction of rotation of the filter medium, passing a portion of the filter medium successively through said spray zones, as the filter medium rotates, and rotating the filter medium at a speed such that coarse particles and liquid developing on said portion of the filter medium in one of said spray zones are removed from said portion, substantially as a result of the centrifugal force said coarse particles and liquid are subjected to by the rotating filter medium, before said portion enters the next spray zone. In consequence, the suspension can be sprayed against said side of the filter medium in a plurality of said spray zones allocated substantially evenly around a rotation axis about which the filter medium is rotated, without risking coarse particles, which develop on the filter medium in one spray zone, to interfere with suspension which is sprayed against the filter medium in another spray zone.

The filter medium may form a cylinder, which is rotated about its axis of symmetry, a cone which also is rotated about its axis of symmetry, or a disc, which is rotated about an axis extending through the centre of the disc and substantially transverse to the disc. In case the filter medium form a cylinder, the suspension is sprayed against the outside of the cylinder, so that coarse particles and liquid developed on the filter medium are removed by centrifugal force radially outwards from the cylinder.

The present invention also relates to a device for separating a suspension containing relatively fine particles and relatively coarse particles. The device comprises a filter sheet with two opposite sides, and drive means for rotating the filter sheet about a rotation axis such that the filter sheet extends at an angle to said rotation axis. Spray means are adapted to spray the suspension against one side of the filter sheet to separate the suspension into a fine fraction of the suspension, which passes through the filter sheet and which contains said fine particles, and a coarse fraction of the suspension, which does not pass through the filter sheet and which contains said coarse particles. The device is primarily characterized in that the drive means is adapted to rotate the filter sheet about said rotation axis at a speed such that coarse particles and liquid developing on said one side of the filter sheet during operation are removed from the filter sheet substantially as a result of the centrifugal force said coarse particles and liquid are subjected to by the rotation of the filter sheet.

According to a preferred embodiment of the device of the invention, the spray means are adapted to spray the suspension against said one side of the filter sheet in at least two spray zones, which are spaced from each other and positioned such that the spray zones are successively passed by a portion of said one side of the filter sheet during rotation of the filter sheet. In addition, the drive means is adapted to rotate the filter sheet at a speed such that coarse particles and liquid developing on said portion during operation are removed from said portion, substantially as a result of the centrifugal force said coarse particles and liquid are subjected to by the rotation of the filter sheet, before said portion enters the next spray zone.

Suitably, the spray means are adapted to spray the suspension against said one side of the filter sheet in a plurality of said spray zones, said spray zones being allocated substantially evenly around said rotation axis.

Figure 2:
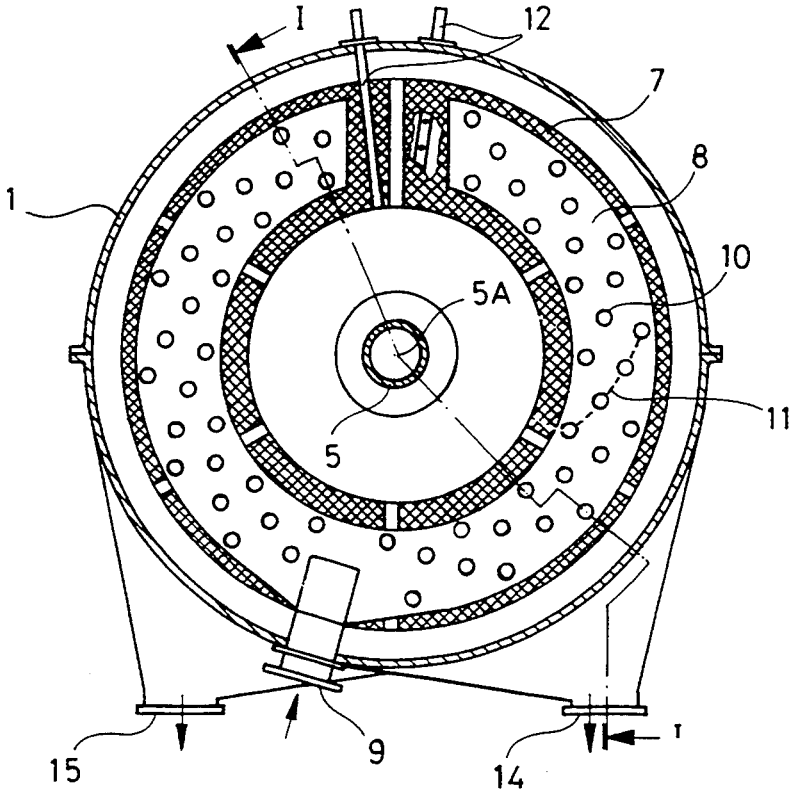
Figure 3:
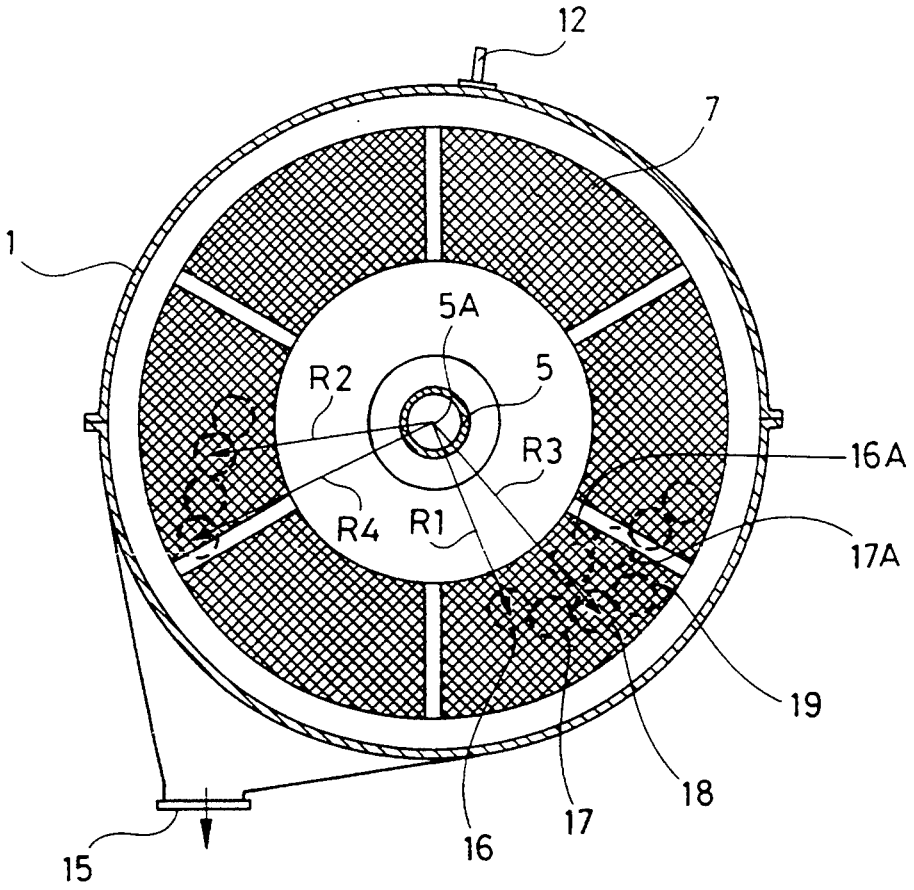
Figure 4:
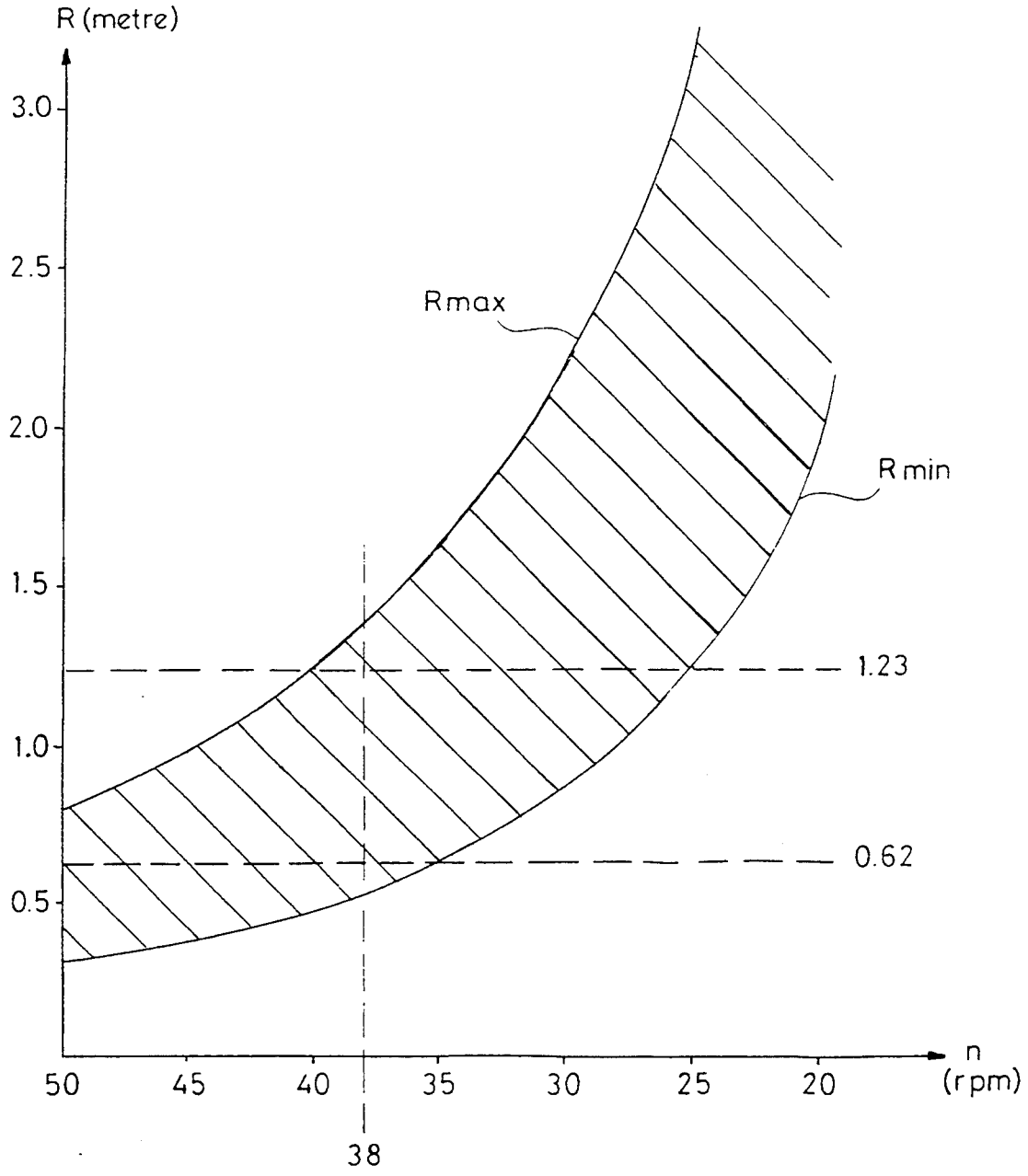

The invention is described in more detail in the following with reference to the accompanying drawing, in which FIG. 1 shows a vertical section through a preferred embodiment of the device according to the invention, FIGS. 2 and 3 show sectional views along the lines II—II and III—III, respectively, in FIG. 1, and FIG. 4 is a diagram illustrating preferred dimensions of the filter sheet of the embodiment shown in FIG. 1, in dependence on the speed of the filter sheet.

The device shown in the FIGS. 1-3 comprises a housing 1, in which four circular vertical discs 2, 3, 3*a* and 4 are attached one after the other on a horizontal shaft 5 transverse to and coaxial with the shaft 5. The shaft 5 is rotatably journalled in the housing 1 about a rotation axis (5A) and connected to a drive motor 6. Each of the discs 2-4 is provided with a circular annular filter sheet 7 having an inner radius:

$$Rmin = 0.62\ meter$$

and an outer radius:

$$Rmax = 1.23\ meter.$$

Two annular hollow distribution discs 8 are arranged right between the discs 2 and 3, and between the discs 3*a* and 4, respectively. Each distribution disc 8 is attached to the housing 1 and provided with an inlet 9 for a suspension to be separated. A great number of spray nozzles 10 (in this case fiftysix) are arranged at each side of the distribution disc 8 and project transversely from these. The spray nozzles 10 are positioned on each distribution disc 8 such that groups of four spray nozzles 10 are formed. The spray nozzles 10 in each group form a row 11 of spray nozzles 10, which extends from the radially inner end of the distribution disc 8 to the radially outer end of the distribution disc 8 and which is curved forwards in the direction of the rotation of the discs 2-4.

Each distribution disc 8 has a break in its circumference at the top of the distribution discs 8. At each side of the discs 2-4, there is a stationary tubular cleansing member 12 extending in front of said break of the associated distribution disc 8 and adapted to spray cleansing liquid, such as water, under high pressure against the filter sheet 7.

A stationary annular intermediate wall 13 extends between the two opposing filter sheets 7 of the discs 3 and 3*a*. The purpose of the intermediate wall 13 is to deflect the created jets of fine fraction, so that these will not hit any of the filter sheets 7.

At the bottom of the housing there are outlets 14 for coarse fraction and outlets 15 for fine fraction.

The spray nozzles 10 at each disc 2-4 are arranged such that the four spray nozzles 10 of each row 11 spray suspension against the filter sheet 7 in a row of four spray zones 16-19 positioned at four various distances R1-R4, respectively, from the axis 5A (FIG. 3). The drive motor 6 is adapted to rotate each disc 2-4 at a speed such that coarse particles and liquid developing on a portion of the filter sheet 7, which passes a spray zone 16 at the distance R1 from the axis 5*a*, are removed from said portion by centrifugal force, before said portion enters the next spray zone 16A. The spray zones 16-19 in the same row of spray zones and the spray zones 16A-19A in the subsequent row of spray zones, as seen in the direction of rotation of the discs 2-4, are positioned relative to each other such that coarse particles and liquid developing on said portion of the filter sheet 7 in the spray zone 16 are pulled by centrifugal force along a flow path extending substantially between the two respective rows of spray zones 16-19 and 16A-19A, and outside the spray zones 16-19, 16A-19A.

Each row of spray zones 16-19 may be regarded as a single spray zone, provided that adjacent spray zones in the row of spray zones 16-19 at least reach each other.

During operation the discs 2-4 are rotated by means of the drive motor 6 at the same time as a suspension to be separated is pumped into the hollow distribution discs 8 via the inlets 9. Via the spray nozzles 10 the suspension is sprayed from the interior of the distribution discs 8 under high pressure against the respective filter sheets of the discs 2-4, so that a fine fraction of the suspension passes through the filter sheets 7, while a coarse fraction of the suspension containing relatively coarse particles is created outside the discs 2-4. The fine fraction falls down towards the bottom of the housing 1 and is discharged from the housing 1 via the outlets 15. Coarse particles and liquid developing on the filter sheets 7 are entrained by the filter sheets, so that said coarse particles and liquid are pulled from the discs 2-4 by centrifugal force. The mixture of coarse particles and liquid removed from the discs 2-4 flow essentially along the inner wall of the housing 1 towards the bottom of the housing 1 and is discharged from the housing 1 via the outlets 14.

The accurate positions of the spray zones 16-19 and the accurate rotational speed of the discs 2-4 depend on the kind of suspension to be separated. Since the present invention is particularly intended for separation of fibre suspensions, a fibre suspension having a fibre concentration of about 0.8% and containing fine impurities was separated by means of a test equipment, in order to establish empirical data. The test equipment included a disc of the same type as the discs 2-4 shown in FIGS. 1-3. Thus, the annular filter sheet of the disc had a minimum radius:

$$Rmin = 0.62\ meter$$

and a maximum radius:

$$Rmax = 1.23\ meter.$$

A stationary spray nozzle was arranged at 150 millimeters from the filter sheet and adapted to spray a completely filled conical liquid jet against the filter medium, said conical liquid jet having a cone angle of 45 degrees. The fibre suspension was sprayed onto the filter sheet in a flow of 114 liter/minute.

First, the disc was rotated at a rotational speed of 20 rpm and the separation efficiency was examined at Rmin and Rmax of the filter sheet. Then, the filter sheet was cleaned and the rotational speed was increased by 5 rpm to 25 rpm. Again, the separation efficiency was examined at Rmin and Rmax of the filter sheet. In this manner the rotational speed was gradually increased by 5 rpm according to the table below:

| The rotational speed of the filter sheet (rpm) | 20 | 25 | 30 | 35 | 40 | 45 | 50 |
|---|---|---|---|---|---|---|---|
| Vmax | 2.6 | 3.2 | 3.9 | 4.5 | 5.2 | 5.8 | 6.5 |
| Vmin | 1.3 | 1.6 | 1.9 | 2.3 | 2.6 | 2.9 | 3.2 |

In the table Vmax and Vmin indicate the velocity of the filter sheet relative to the suspension jet from the spray nozzle at the radii Rmax and Rmin, respectively, of the filter sheet.

It turned out that the separation efficiency at Rmin of the filter sheet was significantly deteriorated at velocities of the filter sheet which were less than 2.3 meter/-second. In addition, it turned out that the separation efficiency at Rmax of the filter sheet was deteriorated at velocities of the filter sheet exceeding 5.2 meter/-second.

Thus, the centrifugal force acting on a separated coarse particle on the filter sheet should be at least:

$$Fmin = \frac{m \cdot V^2\text{min}}{Rmin} = \frac{m \cdot 2.3^2}{0.62} = 8.5\ m$$

(Fmin=the minimum centrifugal force)
(m=the weight of the coarse particle)
and should not exceed:

$$Fmax = \frac{m \cdot V^2\text{max}}{Rmax} = \frac{m \cdot 5.2^2}{1.23} = 22\ m$$

(Fmax=the maximum centrifugal force).
A combination of:

$$Fmin \geqq \frac{m \cdot V^2}{Rmin}\ (Fmin = 8.5\ m)$$

$$V = \frac{2\pi n}{60} \cdot Rmin$$ ($n$ = the rotational speed of the filter sheet in rpm)

gives the following function:

$$Rmin \geqq 8.5 \left(\frac{60}{2\pi n}\right)^2$$

which is illustrated in FIG. 4 as a graph Rmin.
A combination of:

$$Fmax \leqq \frac{m \cdot V^2}{Rmax}\ (Fmax = 22\ m)$$

$$V = \frac{2\pi n}{60} \cdot Rmax$$

gives the following function:

$$Rmax \leqq 22 \left(\frac{60}{2\pi n}\right)^2$$

which is illustrated in FIG. 4 as a graph Rmax.

Accordingly, the values of the inner and outer radii of the annular filter sheet 7 should be located in the field between the two graphs Rmin and Rmax in FIG. 4.

The optimum rotational speed of the filter sheet 7 is calculated as follows:

$$Fmean = \frac{Fmax + Fmin}{2}$$ (Fmean = the mean centrifugal force)

$$Fmean = \frac{22\ \text{m} + 8.5\ m}{2} = 15\ m$$

$$Rmean = \frac{Rmax + Rmin}{2}$$ (Rmean = the mean radius of the filter sheet 7)

$$Rmean = \frac{1.23 + 0.62}{2} = 0.93$$

A combination of:

$$Fmean = \frac{m \cdot V^2}{Rmean}$$

$$V = \frac{2\pi n}{60} \cdot Rmax$$

gives:

$$n = \frac{60}{2\pi}\sqrt{\frac{Fmean}{Rmean \cdot m}} = \frac{60}{2\pi}\sqrt{\frac{15 \cdot m}{0.93 \cdot m}} = 38\ (\text{rpm})$$

The optimum rotational speed of the filter sheet (38 rpm) is noted in the diagram of FIG. 4.

As mentioned above the particular fibre suspension tested had a fibre concentration of about 0.8%. However, the empirical data obtained by the test equipment would also be valid for fibre suspensions having a fibre concentration in the range of 0.2–2.0%

I claim:

1. A method of separating a suspension containing relatively fine particles and relatively coarse particles which comprises spraying the suspension against a side of a rotating filter medium so that a fine fraction of the suspension containing said fine particles is forced through the filter medium, while a coarse fraction of the suspension containing said coarse particles does not pass through the filter medium, rotating said filter medium about an axis at a speed sufficient to move coarse particles and liquid of said coarse fraction left on the filter medium by centrifugal force radially of said axis and removing substantially all said coarse particles and liquid from said side of said filter medium by said centrifugal force.

2. A method according to claim 1 and comprising:

spraying the suspension against said side of the filter medium in at least two spray zones, which are spaced from each other in the direction of rotation of the filter medium, passing a portion of the filter medium successively through said spray zones as the filter medium rotates, and rotating the filter medium at a speed such that substantially all coarse particles and liquid developing on said portion of the filter medium in one of said spray zones are removed from said portion, as a result of the centrifugal force said coarse particles and liquid are subjected to by the rotating filter medium, before said portion enters the next spray zone.

3. A method according to claim 2, and comprising spraying the suspension against said side of the filter medium in a plurality of said spray zones allocated substantially evenly around a rotation axis about which the filter medium is rotated.

4. A method according to claim 2, and comprising rotating the filter medium about a rotation axis, positioning the filter medium relative to said rotation axis such that said side of the filter medium extends at an angle to said rotation axis, spraying the suspension against said side of the filter medium in at least two further spray zones situated substantially at the same distance from said rotation axis and radially outside said spray zones, so that said further spray zones are successively passed by a further portion of the filter medium, as the filter medium rotates, positioning said further spray zones relative to each other such that substantially all coarse particles and liquid developing on said further portion in one of said further spray zones are removed from said further portion, as a result of the centrifugal force said coarse particles and liquid are subjected to by the rotating filter medium, before said further portion enters the next said further spray zone, and positioning said further spray zones relative to said two spray zones such that substantially all coarse particles and liquid developing on said first portion in one (16) of said two spray zones are pulled by centrifugal force along a flow path extending at least substantially outside said further spray zones.

5. A method according to claim 4, and comprising spraying the suspension against said side of the filter medium in said two spray zones and said further spray zones allocated substantially evenly around said rotation axis.

6. A device for separating a fiber suspension containing relatively fine particles and coarse particles in the form of fibers and having a fiber concentration in the range of 0.2 to 2.0% comprising a filter sheet in the shape of a circular annular disc having a center and two opposite sides, drive means for rotating said filter sheet about a rotational axis extending through the center of said filter sheet substantially transversely thereto, spray means positioned to spray the fiber suspension against one side of the filter sheet to separate the suspension into a fine fraction which passes through the filter sheet and which contains fine particles, and a coarse fraction which does not pass through the filter sheet and which contains said coarse particles, wherein the drive means rotates the filter sheet about said axis at a speed such that the coarse particles and liquid developing on said one side of the filter sheet during operation are received from the filter sheet substantially as the result of the centrifugal force said coarse particles are subjected to by said rotation, wherein:

the radially inner circumference of the annular filter sheet is situated at a minimum distance (Rmin) from said rotation axis such that the following conditions are fulfilled:

$$Rmin \geqq 8.5\left(\frac{60}{2\pi n}\right)^2$$

where Rmin is the minimum distance from the rotation axis in meters, and n is the rotational speed of the filter sheet in rpm.

7. A device according to claim 6, wherein the radially outer circumference of the annular filter sheet is situated at a maximum distance (Rmax) from said rotation axis such that the following conditions are fulfilled:

$$Rmax \leqq 22\left(\frac{60}{2\pi n}\right)^2$$

Rmax = the maximum distance from the rotation axis in meters n = the rotational speed of the filter sheet in rpm.

* * * * *

UNITED STATES PATENT AND TRADEMARK OFFICE

CERTIFICATEOF CORRECTION

PATENT NO. : 5,441,157

DATED : August 15, 1995

INVENTOR(S) : Roland Fjallstrom

It is certified that error appears in the above-identified patent and that said Letters Patent is hereby corrected as shown below:

| | | |
|---|---|---|
| Col. 1, | line 17, | cancel "liter" and substitute --filter--. |
| Col. 7, | line 22, | (Claim 4) cancel "said". |
| Col. 8, | line 22, | (Claim 6) after "Rmin", cancel "≧" and substitute --≥--. |
| Col. 8, | line 34, | (Claim 7) after "Rmax", cancel "≦" and substitute --≤--. |

Signed and Sealed this

Second Day of July, 1996

Bruce Lehman

*Attest:*

BRUCE LEHMAN

*Attesting Officer*

*Commissioner of Patents and Trademarks*